US007645168B2

(12) United States Patent
Neumetzler et al.

(10) Patent No.: US 7,645,168 B2
(45) **Date of Patent: *Jan. 12, 2010**

(54) DISTRIBUTION MODULE FOR CONVERTING BETWEEN SYMMETRICAL AND ASYMMETRICAL DATA TRANSMISSION PATHS

(75) Inventors: Heiko Neumetzler, Berlin (DE); Harald Klein, Berlin (DE); Johann Oltmanns, Berlin (DE); Antony Nijhuis, Modautal-Brandau (DE)

(73) Assignee: ADC GmbH, Berlin (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/359,699

(22) Filed: Jan. 26, 2009

(65) Prior Publication Data

US 2009/0149075 A1 Jun. 11, 2009

Related U.S. Application Data

(63) Continuation of application No. 11/661,659, filed as application No. PCT/EP2005/009318 on Aug. 30, 2005, now Pat. No. 7,491,093.

(30) Foreign Application Priority Data

Sep. 10, 2004 (DE) ..... 10 2004 043 763

(51) Int. Cl.
*H01R 25/00* (2006.01)

(52) U.S. Cl. ..... 439/638; 439/620.21

(58) Field of Classification Search ..... 439/638, 439/620.21, 676
See application file for complete search history.

(56) References Cited

U.S. PATENT DOCUMENTS

| | | | | |
|---|---|---|---|---|
| 5,217,394 | A | 6/1993 | Ho | |
| 5,639,262 | A | 6/1997 | Lim | |
| 6,086,415 | A | 7/2000 | Sanchez et al. | |
| 6,250,936 | B1 | 6/2001 | Armistead et al. | |
| 6,368,120 | B1 | 4/2002 | Scherer et al. | |
| 7,270,551 | B2 * | 9/2007 | Busse et al. | 439/76.1 |
| 2001/0053627 | A1 | 12/2001 | Armistead et al. | |
| 2006/0114660 | A1 | 6/2006 | Busse et al. | |
| 2006/0286824 | A1 | 12/2006 | Busse et al. | |

FOREIGN PATENT DOCUMENTS

| | | | |
|---|---|---|---|
| DE | 102 36 361 | A1 | 3/2004 |
| EP | 0 587 367 | A1 | 3/1994 |
| WO | WO 2004/001962 | A1 | 12/2003 |

* cited by examiner

*Primary Examiner*—Tho D Ta
*Assistant Examiner*—Travis Chambers
(74) *Attorney, Agent, or Firm*—Merchant & Gould P.C.

(57) ABSTRACT

The invention relates to a distribution module for converting between symmetric and non-symmetric data transmission paths. Said distribution module comprises a housing in which a transformer is arranged for adjusting impedance, first contacts for connecting at least one non-symmetric data cable, and second contacts for connecting at least one symmetric data cable. The first and second contacts are disposed on opposite faces of the housing. The second contacts are embodied as at least one RJ45 plug-in connector.

10 Claims, 3 Drawing Sheets

DISTRIBUTION MODULE FOR CONVERTING BETWEEN SYMMETRICAL AND ASYMMETRICAL DATA TRANSMISSION PATHS

This application is a Continuation of U.S. Ser. No. 11/661,659, filed 20 Sep. 2007, now U.S. Pat. No. 7,491,093, which is a national stage of PCT/EP2005/009318, filed 30 Aug. 2005, which claims benefit of Ser. No. 10 2004 043 763.7, filed 10 Sep. 2004 in Germany and which applications are incorporated herein by reference. To the extent appropriate, a claim of priority is made to each of the above disclosed applications.

BACKGROUND OF THE INVENTION

The invention relates to a distribution module for converting between symmetrical and asymmetrical data transmission paths.

Such a distribution module has been disclosed, for example, in WO 2004/001962 A2, in which conversion takes place between an asymmetrical coaxial data transmission path and a symmetrical twisted pair of wires. The distribution module, also known as Balun, comprises a housing, in which a transformer is arranged, by means of which impedance matching takes place. The asymmetrical data line has, for example, 75 ohms and the symmetrical data line has 100 or 120 ohms. It is possible with impedance matching to then reduce reflections at the transition point. On the end face, the housing has contacts for the purpose of connecting the coaxial cable and, on the opposite end face, contacts for the purpose of connecting at least one pair of wires.

SUMMARY OF THE INVENTION

The invention is based on the technical problem of providing an improved distribution module.

For this purpose, the second contacts are in the form of at least RJ45 plug connector. By this means, contact is made with the symmetrical data transmission path in a very simple manner using a prefabricated patch cable, the known RJ45 plug connectors already being designed for very high transmission rates in the range of a few 100 MHz.

In one further preferred embodiment, the first contacts are in the form of coaxial plug connectors. Coaxial cables have very good radio-frequency transmission properties and are therefore used in addition to optical transmission paths, preferably for E1 transmission paths.

In one further preferred embodiment, at least four first contacts are assigned to an RJ45 plug connector. By this means, it is also possible at the same time to produce two or more transmission paths. If the first contacts are in the form of coaxial plug connectors having an inner and an outer conductor, at least two coaxial plug connectors are thus connected to one RJ45 plug connector.

In one further preferred embodiment, eight first contacts are assigned to an RJ45 plug connector, i.e. all of the contacts of the RJ45 plug connector are connected. This makes possible an extremely high packing density.

In a further preferred embodiment, the distribution module is formed with at least four RJ45 plug connectors, with the result that up to 32 first contacts can be connected.

In a further preferred embodiment, the housing is made of metal, more preferably of an NiRo sheet. This achieves good EMC, since the transformers represent a considerable source of disruption.

In a further preferred embodiment, the end faces bearing the contacts have different widths, the RJ45 plug connectors being arranged on the narrower end face.

In a further preferred embodiment, annular or forked contacts are arranged to the side of the narrower end face. These contacts make it possible for the distribution module to be clamped or latched mechanically onto round rods which act as the mounting frame. Furthermore, a ground connection via the round rods can be produced using the annular or forked contacts. For this purpose, for example, the shields of the coaxial cables and/or of the wires to be connected to the RJ45 plug connectors are connected to the annular or forked contacts.

The annular or forked contacts are preferably in the form of twin contacts, further preferably such a twin contact being arranged on each side of the end face. This makes it possible for the ground line in the housing to be selected to be shorter and to be split uniformly. Furthermore, the twin contact also improves mechanical robustness.

In a further preferred embodiment, the annular or forked contacts are electrically connected to ground lines on a printed circuit board. In addition to the abovementioned shields, overvoltage protection elements may also be connected to ground via the ground lines.

BRIEF DESCRIPTIONS OF THE DRAWINGS

The invention will be explained in more detail below with reference to a preferred exemplary embodiment. In the figures:

FIG. 1. shows a perspective front view of a distribution module,

DETAILED DESCRIPTION OF THE PREFERRED EMBODIMENTS

Figure 1:
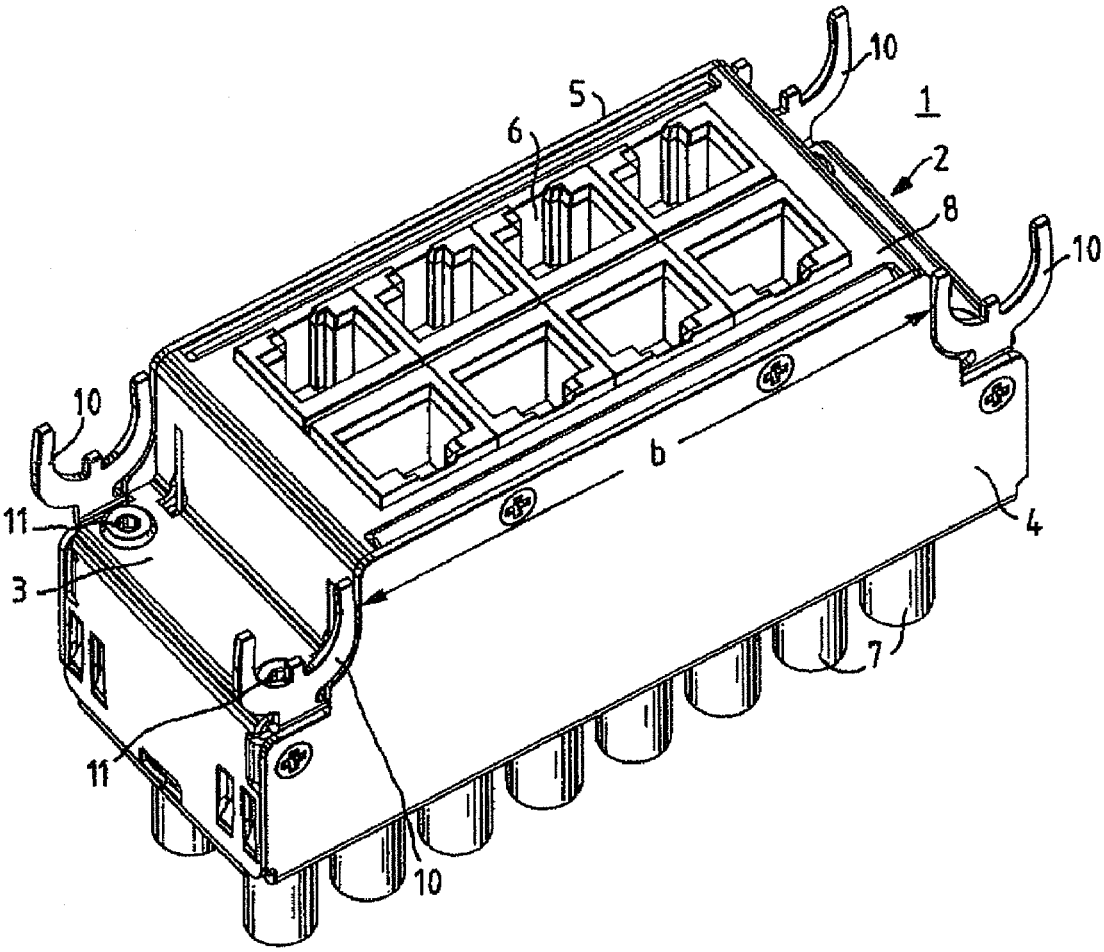
Figure 2:
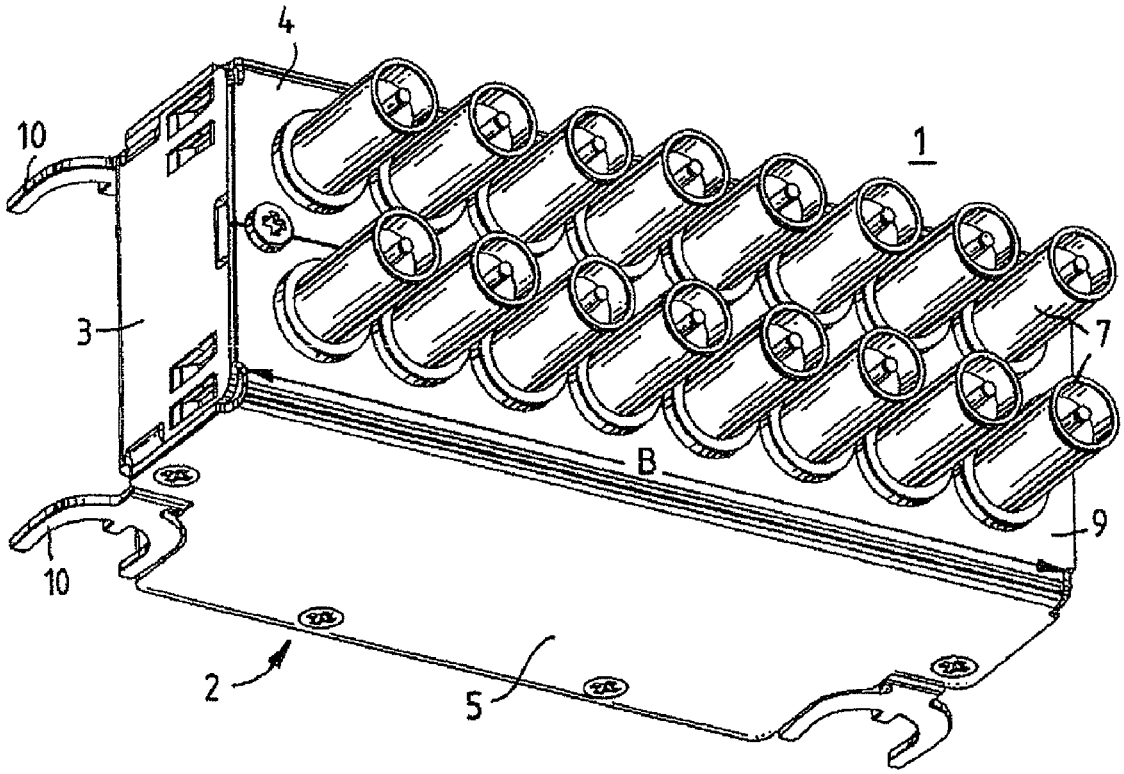
FIG. 2 shows a perspective rear view of the distribution module.
Figure 3:
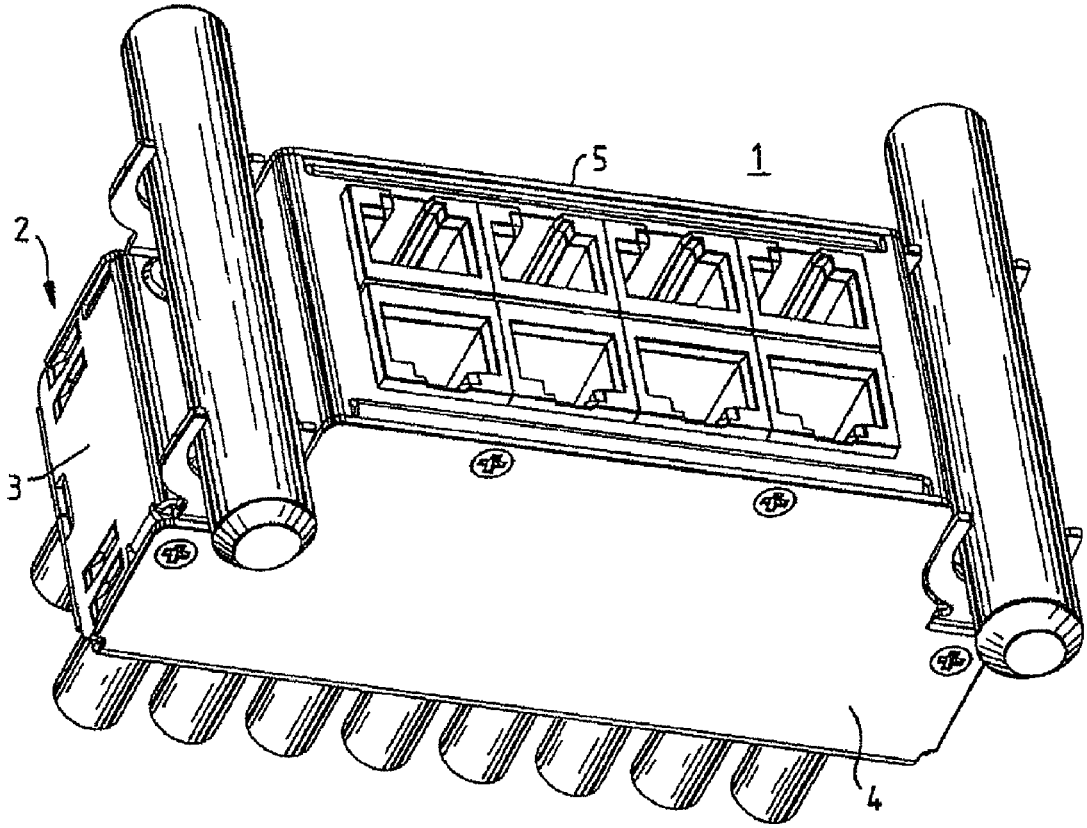
FIG. 3 shows a perspective front view of the distribution module latched onto round rods.

The distribution module 1 comprises a housing 2, which comprises a frame part 3, a base part 4 and a roof part 5. The frame part 3 forms the side walls of the housing 2 and the front part of the housing 2, an opening being provided in the front part for the purpose of inserting eight RJ45 plug connector sockets 6. The base part 4 and the roof part 5 also form, in addition to the base and the roof, in each case half of the rear part of the housing 2. In the respective parts of the base part 4 and the roof part 5 which form the rear part, in each case openings are provided for eight coaxial plug connector sockets 7. As can be seen in FIGS. 1 and 2, the frame part 3, the base part 4 and the roof part 5 are screwed to one another. In this case, the base part 4 and the roof part 5 are preferably of identical construction, which reduces the number of different parts. The end face 8 having the RJ45 plug connector sockets 6 in this case has a narrower width b than the end face 9 having the coaxial plug connector sockets 7, which has the width B. Arranged next to the end face 8, in each case, is a forked twin contact 10 which is screwed using screws 11 to the frame part 3. In this case, the open part of the forked twin contact 10 points in the direction of the end face 8. In the interior of the housing 2, the RJ45 plug connector sockets 6, the coaxial plug connector sockets 7 and transformers for impedance matching are arranged on printed circuit boards (not shown).

In the example illustrated, the connector module comprises sixteen coaxial plug connector sockets 7. Since each coaxial plug connector socket 7 comprises an inner and an outer conductor, 16×2=32 electrical connections can thus be produced between the coaxial plug connectors 7 and the RJ45 plug connector sockets 6. However, by definition, each RJ45 plug connector has eight contacts. In the present case, the end face 8 thus has 8×8=64 contacts. In this configuration, only four of the RJ45 contacts are thus connected, i.e. in each case two coaxial plug connector sockets 7 are associated with one RJ45 plug connector socket 6.

In this case, the Tx1 contacts of a coaxial plug connector 7 suitable for this transmission direction are preferably connected to the pins 1, 2, and the Rx1 contacts of a coaxial plug connector 7 suitable for the reception direction are connected to the pins 4, 5 of the RJ45 plug connector 6. In this case, there is clear channel assignment from E1 to RJ45, i.e. eight E1 channels are connected to eight RJ45 plug connectors.

A more compact design is produced when, instead of the eight RJ45 plug connector sockets 6, only four RJ45 plug connector sockets 6 are used. In this case, in each case two E1 channels are connected to an RJ45 plug connector. For this purpose, the two Tx2 contacts are also connected to the pins 3, 6 and the two Rx2 contacts are connected to the pins 7, 8 of the RJ45 plug connector.

LIST OF REFERENCE NUMERALS

1 Distribution module
2 Housing
3 Frame valve
4 Base part
5 Roof part
6 RJ45 plug connector sockets
7 Coaxial plug connector sockets
8 End face
b Width of the end face 8
9 End face
B Width of the end face 9
10 Forked twin contact
11 Screws

The invention claimed is:

1. A distribution module for converting between symmetrical and asymmetrical data transmission paths, the distribution module comprising:

a housing, in which at least one transformer is arranged for impedance matching;

a first connector having first contacts coupled to at least one asymmetrical data cable; and a second connector having second contacts coupled to at least one symmetrical data cable, the second plug connector being configured to connect to the first plug connector;

the first and second contacts being arranged on first and second end faces, respectively, of the housing, wherein the first end face is oriented in a first direction and the second end face is oriented in a second, opposite direction;

wherein the first and second end faces of the housing have different widths, the second end face being narrower than the first end face, and wherein annular or forked contacts are arranged on the housing, each annular or forked contact having an open side facing in the second direction.

2. The distribution module of claim 1, wherein the annular or forked contacts form a grounding contact.

3. The distribution module of claim 1, wherein the annular or forked contacts include a first annular or forked contact arranged at a first side of the housing and a second annular or forked contact arranged at a second side of the housing.

4. The distribution module of claim 1, wherein the first contacts include coaxial plug connectors.

5. The distribution module of claim 4, wherein the first contacts include sixteen coaxial plug connectors.

6. The distribution module of claim 4, wherein each coaxial plug connector includes an inner conductor and an outer conductor.

7. The distribution module of claim 4, wherein the second contacts include RJ45 plug connectors.

8. The distribution module of claim 7, wherein at least two of the coaxial plug connectors are connected to one of the RJ45 plug connector.

9. The distribution module of claim 7, wherein eight of the second contacts are assigned to one of the RJ plug connectors.

10. The distribution module of claim 7, wherein the first contacts are arranged into two rows of four coaxial plug connectors and the second contacts are arranged into two rows of eight RJ45 plug connectors.

* * * * *